United States Patent [19]

Dyer

[11] Patent Number: 4,744,717

[45] Date of Patent: May 17, 1988

[54] VEHICLE LIFTING DEVICE

[76] Inventor: Kenneth F. Dyer, 182 Harborn Trail, Mississauga, Ontario, Canada, L5B 1A8

[21] Appl. No.: 820,236

[22] Filed: Jan. 21, 1986

[30] Foreign Application Priority Data

Jul. 8, 1985 [CA] Canada ..... 486468

[51] Int. Cl.[4] ..... B66F 7/22

[52] U.S. Cl. ..... 414/678; 254/94; 269/55

[58] Field of Search ..... 254/94, 1; 29/273; 414/678, 778; 280/47.12, 47.15, 46; 269/17, 55

[56] References Cited

U.S. PATENT DOCUMENTS

| | | | |
|---|---|---|---|
| 1,240,453 | 9/1917 | Houghton . | |
| 1,288,138 | 12/1918 | Nicoson . | |
| 1,478,256 | 12/1923 | Reid . | |
| 1,692,715 | 11/1928 | Williamson . | |
| 1,893,822 | 1/1933 | Guerriero . | |
| 2,424,196 | 7/1947 | Sleeper | 214/1 |
| 3,022,995 | 2/1962 | Sorenson et al. | 269/55 |
| 3,565,397 | 2/1971 | Judge | 254/94 |
| 3,674,252 | 7/1972 | Crabtree et al. | 254/94 |
| 3,761,058 | 9/1973 | Stone et al. | 254/94 |
| 4,221,416 | 9/1980 | Piontkowski et al. | 294/17 |
| 4,498,841 | 2/1985 | Wickström | 414/778 |
| 4,594,048 | 6/1986 | Sipla | 414/678 |

FOREIGN PATENT DOCUMENTS

| | | | |
|---|---|---|---|
| 206791 | 9/1955 | Australia | 414/678 |
| 1129868 | 3/1955 | France | 414/678 |
| 431294 | 8/1967 | Switzerland . | |
| 598974 | 5/1978 | Switzerland . | |

OTHER PUBLICATIONS

Car Consult Aps, "AutoVip", brochure relating to U.K. Pat. No. 2,150,113.

*Primary Examiner*—Frederick R. Schmidt
*Assistant Examiner*—Judy J. Hartman
*Attorney, Agent, or Firm*—Parkhurst & Oliff

[57] ABSTRACT

An improved cradle for a vehicle lifting device, comprising longitudinally spaced bearer elements at diametrically opposed portions of the rim of the vehicle wheel, is affixed to the vehicle wheel by attachment means having recesses or sockets to fit over the lug nuts, or sockets or hexrod bolts to fit over the wheel studs, of the vehicle wheel.

11 Claims, 7 Drawing Sheets

FIG. 1
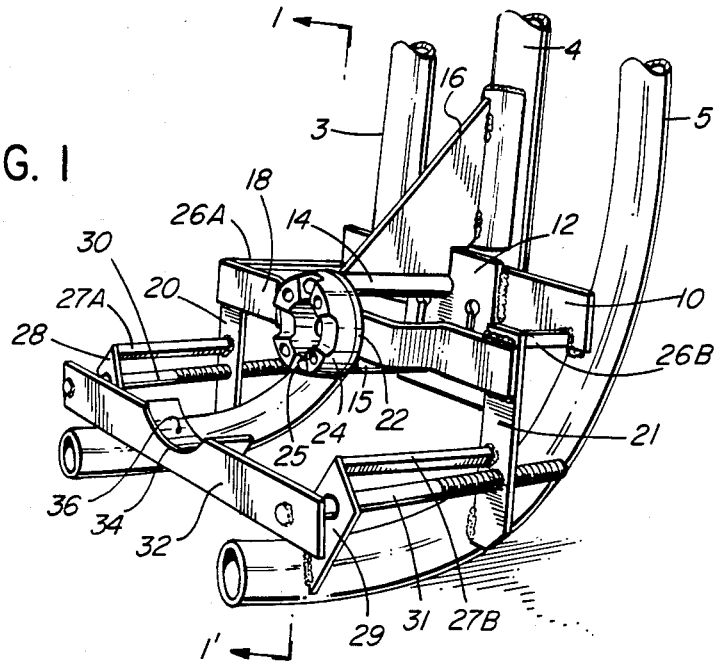
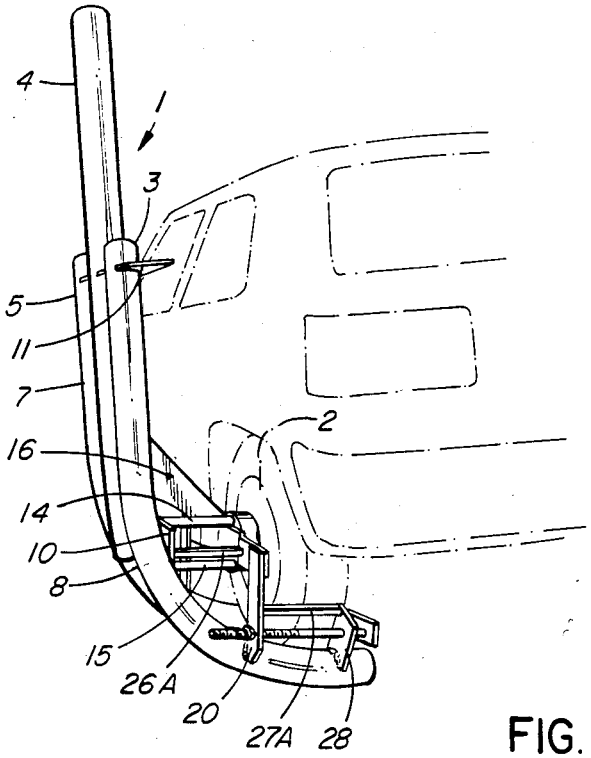
FIG. 2

VEHICLE LIFTING DEVICE

FIELD OF THE INVENTION

This invention relates to an improved cradle for a vehicle lifting device, including improved attachment means therefor.

BACKGROUND OF THE INVENTION

The transportation of vehicles over long distances is facilitated by the use of vehicle lifting devices, comprising cradle means, which enable a vehicle to be rolled over and supported on its side in a raised position. Such vehicle lifting devices permit substantial reductions in the space required for the transportation of the vehicles by road, rail, air or sea. The use of these devices also allows vehicles to be easily displayed, at car shows and in showrooms, without the necessity of removing any of the operative parts of the vehicle.

The use of a vehicle lifting device having cradle means for raising a vehicle by a sideways tilting or rolling action is disclosed in Canadian Pat. No. 917,135 and corresponding U.S. Pat. No. 3,674,252 to Crabtree and Horacek. The cradle means therein disclosed has a pair of single or double curved bearers with means for attaching the bearers to a vehicle wheel hub. A cross-bar is then attached to a pair of cradle means affixed to the front and rear wheel hubs on one side of the vehicle, to form a bracing stay. When the bracing stay is in position, the vehicle can be rolled over and supported on its side.

The vehicle lifting device disclosed in the aforementioned Canadian and U.S. patents sets out, as the means for attaching the bearers to the vehicle, an inwardly extending flanged bracket which is mounted on the wheel studs of the wheel mounting hub after the wheel has been removed. The flanged brackets has holes or slots formed therein, within which to receive the wheel studs. Because the number of wheel studs varies from four to five in number, depending on the vehicle, it is necessary to have two kinds of flanged brackets and to replace the brackets when the cradles are used with differently sized vehicles. In addition, the existing flanged brackets may have their flanges bent, or may cause the wheel studs to break off the vehicle, if the brackets are improperly installed or repeatedly used without proper checks. Furthermore, the need to remove the tire and wheel, before the cradle means can be affixed to the vehicle, necessitates additional steps which are time consuming and which require additional equipment to lift the vehicle.

The previously disclosed device also requires additional means of support, such as steel arms or supports in contact with the wheelhouse frame, to stabilize the front wheels of vehicles which do not have locking steering mechanisms.

The previously disclosed device also requires that a cross-bar, tying the front and rear cradles together, be used if the front and back wheels are to remain parallel to each other, and that a vertical safety leg or brake be affixed to the cradle to prevent the vehicle from rolling back onto its wheels after it has been turned onto its side.

SUMMARY OF THE INVENTION

The present invention provides an improved cradle, for a vehicle lifting device, capable of being used with virtually any car presently manufactured without requiring that the tire and wheel be removed from the car before the cradle is attached. The present invention does not require the support of rods which are in contact with the wheelhouse frame. The present invention also does not require that a vertical brake or leg be used to prevent the vehicle from rolling back onto its wheels; rather, the invention has a stabilizing bar. The present invention also permits the front and back wheels to remain parallel to one another (on a planar surface) even if the front wheels have a tendency to turn, without the use of a cross-bar to tie the front and rear wheel cradles together. The improved wheel lifting device can be used to raise the vehicle by a sideways tilting or rolling action, and in addition thereto, can also be used to enable the vehicle, once on its side, to be hoisted by a crane. In one embodiment, the improved vehicle lifting device is mounted to the vehicle wheel by means of a universal plate, which obviates the necessity of having to change plates for the different wheel stud configurations found on differently-sized vehicles.

More particularly, the present invention relates to a cradle, for a vehicle lifting device for rolling a vehicle over on its side and supporting the vehicle on its side in a raised position, comprising: longitudinally spaced bearer elements, at diametrically opposed portions of a rim of a vehicle wheel assembly of the vehicle, joined by a longitudinally extending cross member, each of the bearer elements curved for at least a portion of its length, the convex surface of the curved portion designed for rolling contact with a supporting surface; and mounting means, projecting inwardly from the concave side of the bearer elements, for engaging a vehicle wheel assembly and thereby securing the cradle to the vehicle.

The present invention also relates to the above cradle, further comprising clamping means, extending from the bearer elements, for engaging the vehicle wheel assembly at a position located on a side of the vehicle wheel assembly opposite from the mounting means.

BRIEF DESCRIPTION OF THE DRAWINGS

FIG. 1 depicts one embodiment of the cradle for the vehicle lifting device.

FIG. 2 depicts the cradle illustrated in FIG. 1 affixed to a vehicle wheel.

DESCRIPTION OF THE PREFERRED EMBODIMENTS

Figure 3:
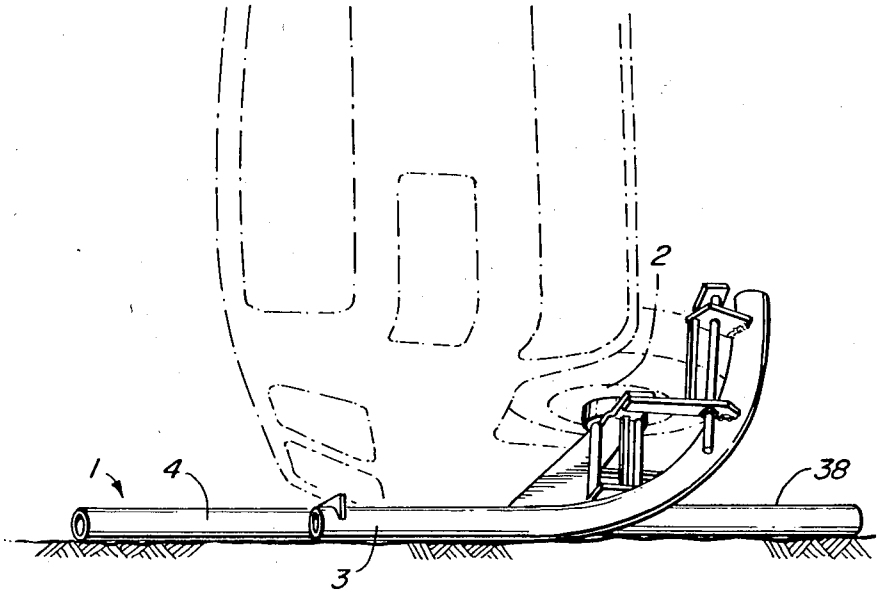
FIG. 3 depicts the cradle of FIG. 2, with the vehicle turned onto its side.
Figure 4:
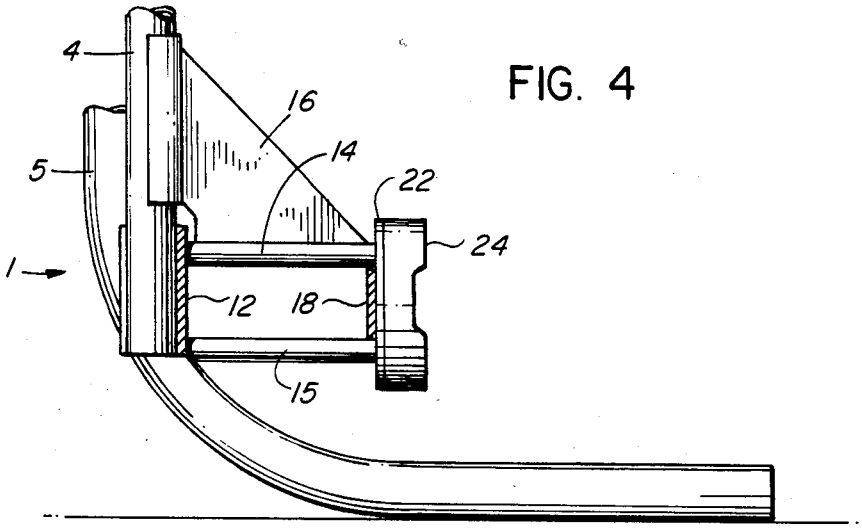
FIG. 4 depicts a partial sectional view of the cradle illustrated in FIG. 1, along line 1—1' thereof.
Figure 5:
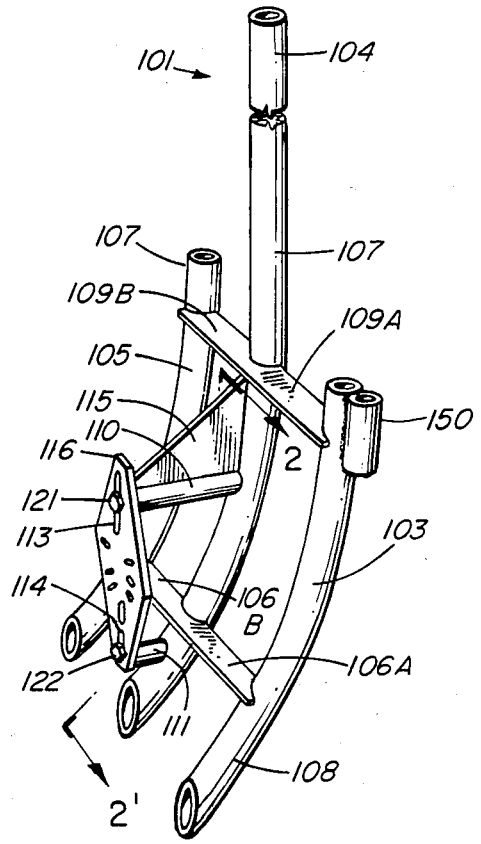
FIG. 5 depicts a second embodiment of the cradle.
Figure 6:
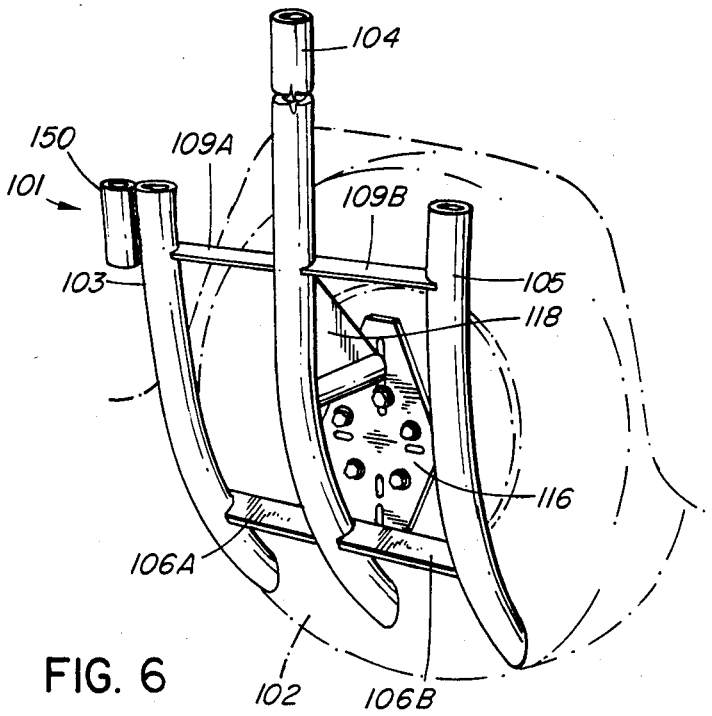
FIG. 6 depicts the cradle illustrated in FIG. 5 affixed to a vehicle wheel.

The preferred embodiments of the invention will now be described in detail.

The cradle shown generally at 1 in FIGS. 1 to 4 includes two longitudinally spaced tubular bearers 3 and 5, these bearers being made from rolled steel or a similar material. Each of tubular bearers 3 and 5 has a straight portion 7 extending from a curved portion 8, curved portion 8 being designed for rolling contact with the surface on which the vehicle is supported. Between bearers 3 and 5 is tubular bar 4, also made from rolled steel or a similar material. Tubular bar 4 is hollow and is capable of having inserted therein stabilizer bar 38, bar 38 being made from rolled steel and being of a smaller diameter than the inside diameter of bar 4. Tie bar 10 and cross bar 11, longitudinally extending across bearers 3 and 5 and bar 4, join the tubular bearers and bar.

Welded to tie bar 10 is plate 12, having extending, inwardly from the concave side of the bearers, rods 14 and 15. Rod 14 is additionally supported by brace 16. Rods 14 and 15 have connected thereto cross bar 18, bar 18 also being supported by plates 20 and 21 extending from tubular bearers 3 and 5, respectively. Plates 20 and 21 are also supported by rods 26A and 26B, respectively, extending from tie bar 10. Fixed plate 22 is affixed to the central part of bar 18.

Affixed to plate 22 by such means as bolts (not herewith shown) is attachment device 24. Attachment device 24 is made of rubber, plastic, or a material similar thereto, so as to prevent attachment device 24 from damaging or marring that part of wheel assembly 2 which is in contact with attachment device 24. As herewith illustrated, attachment device 24 has four recesses 25 formed therein; however, a five hole configuration could also be used, where appropriate, for attachment device 24. Attachment device 24 can be removed from plate 22 and replaced with a differently-configured attachment device 24 when required. Attachment device 24 is pressed against the lug nuts of wheel assembly 2 after the wheel cover or hubcap therefor has been removed. The lug nuts fit tightly into recesses 25 and are held there by the weight of the car as the car is rolled on its side.

Extending further inwardly from plates 20 and 21 are, respectively, bars 27A and 27B; bars 27A and 27B are, in turn, welded to plates 28 and 29 and provide additional support thereto. Plates 28 and 29, and plates 20 and 21, have formed therein apertures through which extend exteriorly-threaded rods 30 and 31. Rods 30 and 31 have welded thereacross longitudinally extending clamping plate 32. Clamping plate 32 has formed therein semi-circular aperture 34 and has extending therefrom, toward wheel assembly 2, curved plate 36. Plate 36 fits between the inside rim and the tire of wheel assembly 2 in order to further hold cradle 1 to wheel assembly 2.

In operation, cradle 1 is positioned against wheel assembly 2 so that bearers 3 and 5 flank the diametrically opposed sides of the tire. Cradle 1 is then simply pushed toward wheel assembly 2 until the lug nuts of wheel assembly 2 are fitted into recesses 25 of attachment device 24. Clamping plate 32, located on the side of the vehicle wheel opposite from attachment device 24, is then adjusted to fit tightly against that side of wheel assembly 2 opposite attachment device 24, by turning rods 30 and 31; when clamping plate 32 is in position against the other side of wheel assembly 2, locking nuts (not herein shown) can be affixed to turning rods 30 and 31. After a second cradle 1 is attached to the other wheel assembly on the same side of the vehicle, the vehicle can be turned onto its side. After the vehicle has been rolled over onto its side, stabilizer bar 38 is inserted into tubular bar 4. Stabilizer bar 38 prevents the vehicle from turning back onto its wheels, just as the extension of tubular bar 4 prevents the vehicle from turning onto its roof.

A second embodiment of the cradle, shown generally as 101, is depicted in FIGS. 5 to 9 and illustrates some of the possible variations for this invention. In this embodiment, three tubular bearers 103, 104 and 105 are formed having a less pronounced curve than that of the bearers in the first embodiment. Bearers 103, 104 and 105 can again be formed from rolled steel or a similar material. Each of bearers 103, 104 and 105 has a straight portion 107 extending from a curved portion 108, curved portion 108 being designed for rolling contact with the surface on which the vehicle is supported. Central tubular bearer 104 has a straight portion 107 extending past straight portions 107 of bearers 103 and 105. Each of rods 103, 104 and 105 has the lower end thereof in close proximity to the tire of wheel assembly 102. Rods 103, 104 and 105 are held in position by longitudinal cross rods 106A and 106B and longitudinal cross rods 109A and 109B.

Affixed to tubular bearer 103 or 104, or to both tubular bearers 103 and 104, is brake receptacle 150; only one brake receptacle 150 is herewith illustrated. Brake receptacle 150 is a straight tubular portion of rolled steel, and is affixed to bearer 103 along straight portion 107 thereof. Brake receptacle 150 is capable of having stabilizing bar 151 inserted therein, stabilizing bar 151 acting, as does stabilizing bar 38 in the first embodiment, to prevent the vehicle from rolling back onto its wheels after it has been turned onto its side.

Extending inwardly from the concave side of central bearer 104 are rods 110 and 111. Affixed to rods 110 and 111 is attachment plate 116. Attachment plate 116 has formed therein two slots 113 and 114, through which extend bolts from rods 110 and 111 extending from central bearer 104. Locking nuts 121 and 122 fix attachment plate 116 to rods 110 and 111. Bracket 115 provides additional support to rod 110.

Figure 8:
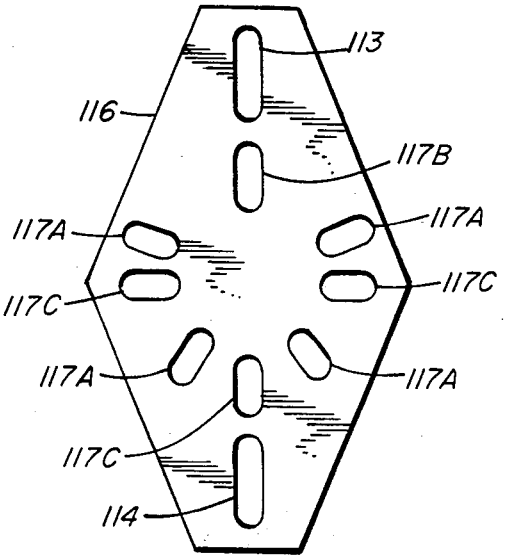
FIG. 8 depicts a front view of the universal mounting plate for the embodiment of the cradle illustrated in FIGS. 5, 6 and 7.
Figure 7:
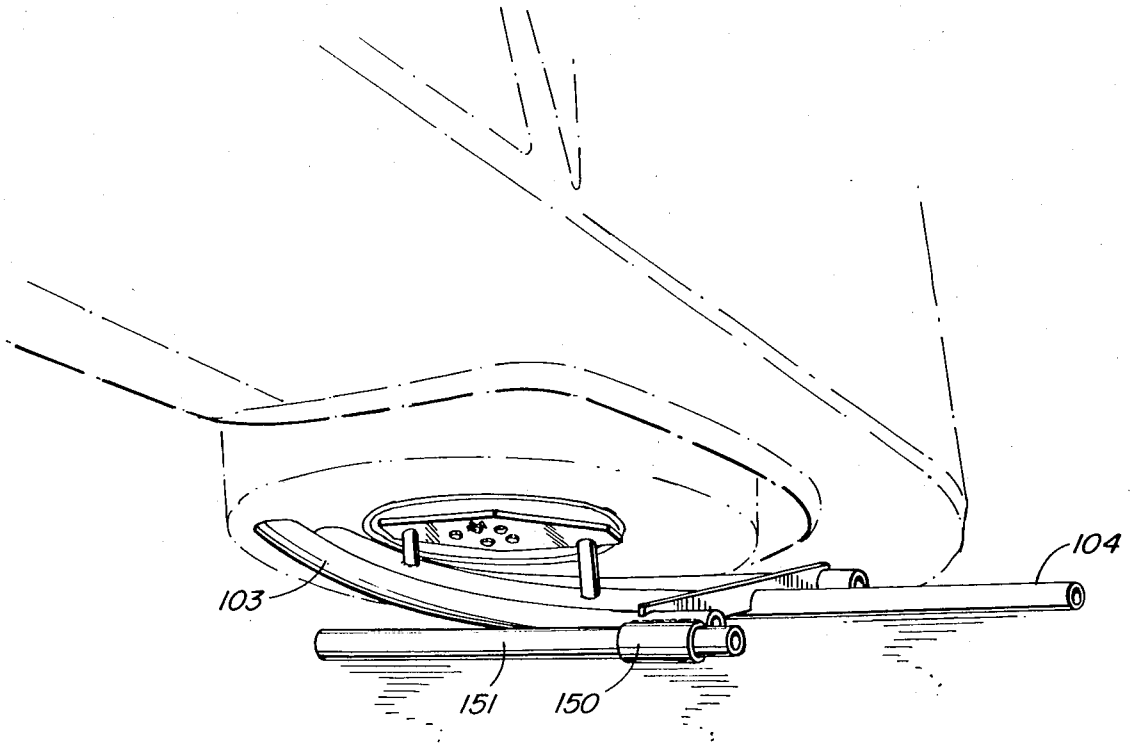
FIG. 7 depicts the cradle of FIG. 6, with the vehicle turned onto its side.

Attachment plate 116 is a universal mounting plate which can be used with cars having wheel studs arranged in either a four hole or a five hole configuration. Attachment plate 116 is preferably made from high tensile steel. FIG. 8 depicts the arrangement of slots 117 which make possible the use of plate 116 for virtually any car manufactured today, that is, any car which has either a four hole or a five hole configuration for its wheel studs. Four slots 117A are spaced 72° apart and have a dimension of approximately $\frac{5}{8}$ by $1\frac{1}{4}$ inches. Single slot 117B, located at the top of plate 116, has a dimension of approximately $\frac{5}{8}$ by $1\frac{1}{2}$ inches. Three slots 117C are spaced 90° apart and have a dimension of approximately $\frac{5}{8}$ by $1\frac{1}{4}$ inches. Plate 116 is capable of being used with 12, 13, 14 and 15 inch tires, which includes virtually all the tire sizes currently being used. Plate 116 is adjusted for use with differently sized tires by adjusting the height of plate 116 along slots 113 and 114.

Figure 9:
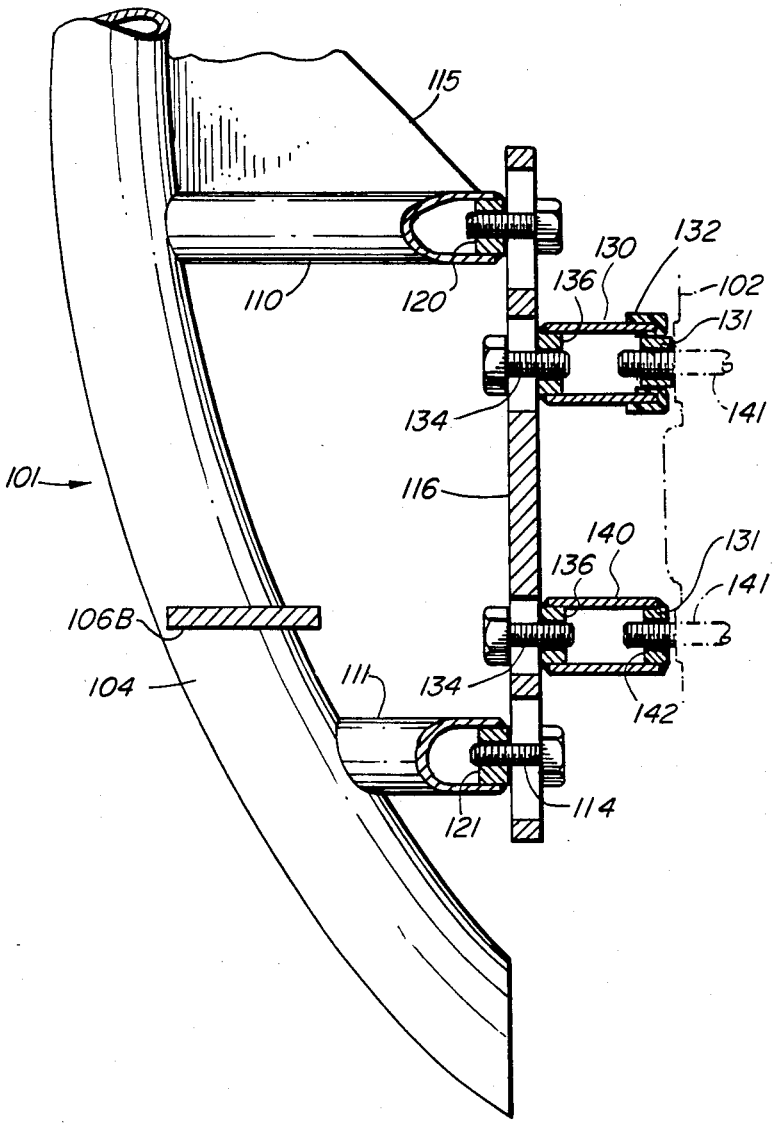
FIG. 9 depicts a partial sectional side view of the cradle of FIG. 5, along line 2—2' thereof, illustrating two different means of attaching the cradle to a vehicle wheel.

Plate 116 can be attached to the wheel in either of two ways, as illustrated in FIG. 9 and herein described.

In the first manner of attaching plate 116 to wheel assembly 102, an appropriate number (that is, four or five, as required) transverse sockets 130 in attachment plate 116 are fitted over lug nuts 131 of wheel assembly 102 after the hub cap therefor has been removed. Each socket 130 has, at the longitudinal end which is in contact with wheel lug nuts 131, circumferential protective sleeve 132 extending partway along the longitudinal length of socket 130. Protective sleeve 132 is made of rubber, plastic, or materials similar thereto, and is used to prevent damaging or marring lug nuts 131. Each of sockets 130 is fitted in an appropriate aperture of attachment plate 116 and is affixed thereto by means of bolt 134 and nut 136, socket 130 fitting over nut 136. Sockets 130 are then simply fitted tightly over lug nuts 131, and the weight of the car is sufficient to hold sockets 130 over lug nuts 131 as the vehicle is rolled over onto its side.

Attachment plate 116 can also be affixed to the wheel by using transverse sockets 140, also illustrated in FIG. 9. Sockets 140 are similar to sockets 130, and are affixed to attachment plate 116 by means of bolt 134 and nut 136, but have, at the longitudinal end thereof which is in contact with the wheel, nut 142 welded therein. Sockets 140 are used where lug nuts 131 of the wheels have been removed; this enables sockets 140 to be threaded directly onto wheel studs 141 of wheel assembly 102, securely holding attachment device 116, and therefore cradle 101, to wheel assembly 102.

Although the use of both sockets 130 and 140 is depicted in FIG. 9, normally only one kind of socket would be used to attach any one cradle 101 to a wheel assembly 102.

Attachment plate 116 can also be affixed to the wheel by other known means. For example, machined hexrod bolts can be used instead of sockets 140; these bolts are again threaded directly onto wheel studs 141 of wheel assembly 102 to hold attachment device 116, and therefore cradle 101, to wheel assembly 102.

A clamping plate can also be used with cradle 101, in a manner analogous to that illustrated in the first embodiment. A clamping bar would be supported by braces extending around the edge of the tire of wheel assembly 102. If sockets 140 are used with attachment device 116, the need for a clamping plate is lessened because of the tight attachment provided by threading nuts 142 onto wheel studs 141 of wheel assembly 102.

The use of two tubular bearers, positioned at peripherally spaced locations of the tire of the vehicle wheel, enables cradle 1 or 101 to be used to maintain the wheels in one position on a planar surface. This means that when two cradles 1 or 101 are used on both the front and back wheels of a vehicle, the front and back wheels remain parallel to one another (on a planar surface) despite the normal tendency of the front wheels to turn. This feature is particularly important in cars which do not have a locking device for the front wheels. In addition, the transportation of the cars is facilitated by the absence of a cross-bar tying the front and rear cradle together, by the absence of a safety leg, and by the absence of supporting wheelhouse bars.

Figure 10:
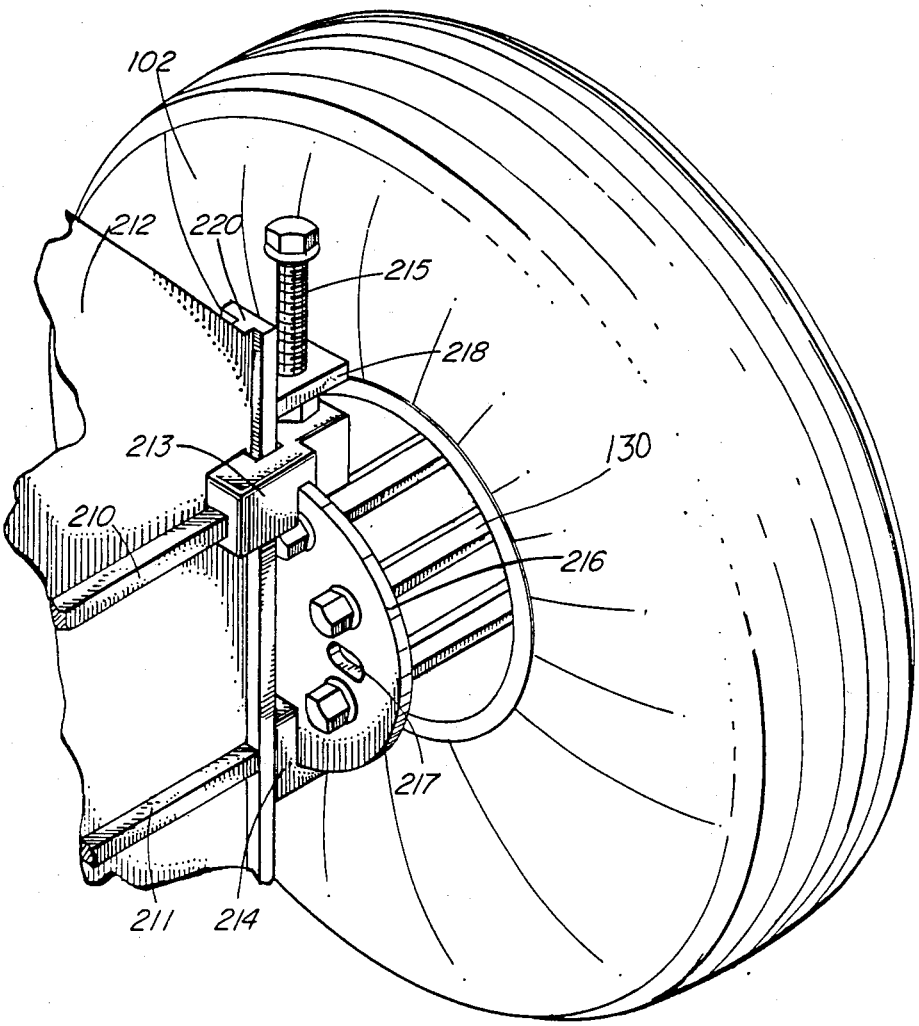
FIG. 10 depicts a third embodiment of the cradle.

A further form of the invention hereinbelow described involves affixing cradle 101 to wheel assembly 102 of the vehicle by means of a circular attachment plate 216, as depicted in FIG. 10. Attachment plate 216 is a universal mounting plate, having formed therein slots 217 in a configuration such as that of plate 116, and is preferably made of high tensile steel. Extending inwardly from the concave side of central bearer 104 of cradle 101 are support bracket 212 and gussets 210 and 211. A track member 220 is fixed to support bracket 212 and a lower plate holder 214 is fixed to track member 220. An upper plate holder or clamp 213 is horizontally restrained but free to move longitudinally (vertically) along track member 220. Circular attachment plate 216 is free to rotate in holders 213 and 214 until a screw 215, held by a guide 218 welded to track member 220 and passing through a threaded aperture in holder 213, comes into contact with attachment plate 216; plate 216 is then held fixedly in holders 213 and 214.

Changing the shape of the universal mounting plate from the diamond shape of attachment plate 116 to the circular shape of attachment plate 216 enables the cradle installation process to be carried out more quickly and easily. When a car comes to rest, the position of the lug nuts 131 (or wheel (FIG. 9) studs 141) on each wheel is not known. Thus, before plate 116 can be attached to wheel assembly 102 of the vehicle, the car has to be lifted (by, for example, the use of a car jack), the brake had to be released, and the wheel of the vehicle has to be rotated so as to align lug nuts 131 or wheel studs 141 of wheel assembly 102 with slots 117 of attachment plate 116. The use of circular attachment plate 216 obviates the necessity of rotating wheel assembly 102 before affixing cradle 101 to the vehicle. Circular attachment plate 216 is rotated until slots 217 are in alignment with lug nuts 131 or wheel studs 141; screw 215 is then lowered to prevent any possible movement of attachment plate 216, and plate 216 is attached to the vehicle in one of the ways heretofore described and illustrated in FIG. 9. Cradle 101 is then securely affixed to the vehicle.

It will be seen that further variation of the particular embodiments herewith described will be evident to one skilled in the art. By way of example, it is clear that the above embodiments could be constructed with two, rather than three, tubular bars or bearers. By way of further example, cradle 1 or 101 can have crane attachment means (most simply, a hole drilled in the upper portion of the central tubular bar or bearer) to enable a crane hook to be anchored to the cradle and the car to be hoisted thereby, thus saving the car from possible damage. Accordingly, the embodiments are to be taken as illustrative rather than limitative, and the true scope of the invention is as set out in the appended claims.

What is claimed is:

1. A cradle for a vehicle lifting device for rolling a vehicle over on its side and supporting said vehicle on its side in a raised position, comprising:

at least one bearer element, curved for at least a portion of its length, the convex surface of said curved portion being designed for rolling contact with a supporting surface; and mounting means on the concave side of said bearer element for engaging a fully assembled vehicle wheel assembly and for securing said cradle to said vehicle without removing said wheel assembly from said vehicle;

said mounting means comprising a support bracket secured to and extending inwardly from said concave side of said bearer element, a vehicle wheel attachment plate located inwardly of said support bracket, means on said support bracket movably securing said wheel attachment plate thereto whereby said wheel attachment plate is free for orientation relative to means securing the vehicle wheel assembly to said vehicle, means engaged with said support bracket for locking said attachment plate in position, and a plurality of elongated connecting members each being secured at one end to said wheel attachment plate and, at the other end, engaging said vehicle wheel securing means of said wheel assembly.

2. A vehicle lift device comprising the cradle of claim 1 affixed to a front vehicle wheel assembly of said vehicle and a second such cradle affixed to a rear vehicle wheel assembly on the same side of said vehicle, whereby said vehicle can be rolled over on its side and supported on its side in a raised position.

3. A cradle according to claim 1, wherein said elongated connecting members are rods having threaded ends for engaging wheel assembly studs on said vehicle, each said rod including a portion of hexagonal cross-section.

4. A cradle according to claim 1, including receptacle means secured to at least one of said bearer elements, and a stabilizer bar for insertion in said receptacle means when said vehicle has been turned onto its side, thereby to prevent said cradle and vehicle from turning back onto its wheels.

5. A cradle for a vehicle lifting device for rolling a vehicle over on its side and supporting said vehicle on its side in a raised position, comprising:

at least one bearer element, curved for at least a portion of its length, the convex surface of said curved portion being designed for rolling contact with a supporting surface; and mounting means on the concave side of said bearer element for engaging a fully assembled vehicle wheel assembly and for securing said cradle to said vehicle without removing said wheel assembly from said vehicle;

said mounting means comprising a support bracket secured to and extending inwardly from said concave side of said bearer element, a vehicle wheel attachment plate located inwardly of said support bracket, track means on said support bracket for movably securing said wheel attachment plate thereto whereby said wheel attachment plate is free for rotary and vertical orientation relative to means securing the vehicle wheel assembly to said vehicle, a pair of plate holding members mounted on said track means of said support bracket, one of said holding members being movable along said track member, means for clamping said wheel attachment plate between said holding members for locking said wheel attachment plate in position relative to said wheel assembly, and a plurality of elongated connecting members each being secured at one end to said attachment plate and, at the other end, engaging said vehicle wheel securing means of said wheel assembly.

6. A vehicle lift device comprising the cradle of claim 5 affixed to a front vehicle wheel assembly of said vehicle and a second such cradle affixed to a rear vehicle wheel assembly on the same side of said vehicle, whereby said vehicle can be rolled over on its side and supported on its side in a raised position.

7. A cradle according to claim 5, wherein each of said elongated connecting members is adapted for engagement with a wheel lug nut of said vehicle wheel assembly.

8. A cradle according to claim 5, wherein each of said elongated connecting members is adapted for engagement with a wheel assembly stud of said vehicle wheel assembly.

9. A cradle according to claim 7, wherein at least that portion of each said elongated connecting member in contact with said wheel lug nut is coated with a protective material.

10. A cradle according to claim 5, wherein said elongated connecting members are rods having threaded ends for engaging wheel assembly studs on said vehicle, each said rod including a portion of hexagonal cross-section.

11. A cradle according to claim 5, including receptacle means secured to at least one of said bearer elements, and a stabilizer bar for insertion in said receptacle means when said vehicle has been turned onto its side, thereby to prevent said cradle and vehicle from turning back onto its wheels.

* * * * *